US008689776B2

(12) United States Patent
Hou et al.

(10) Patent No.: US 8,689,776 B2
(45) Date of Patent: Apr. 8, 2014

(54) PAINTBALL GUN FLOW CHANNEL SYSTEM

(76) Inventors: Guang-Jia Hou, New Taipei (TW); Cheng-Lin Chan, New Taipei (TW)

( * ) Notice: Subject to any disclaimer, the term of this patent is extended or adjusted under 35 U.S.C. 154(b) by 134 days.

(21) Appl. No.: 13/468,296

(22) Filed: May 10, 2012

(65) Prior Publication Data

US 2013/0298892 A1 Nov. 14, 2013

(51) Int. Cl.
*F41B 11/00* (2013.01)

(52) U.S. Cl.
USPC ..... 124/73; 124/71

(58) Field of Classification Search
USPC ..... 124/71–77
See application file for complete search history.

(56) References Cited

U.S. PATENT DOCUMENTS

| | | | | |
|---|---|---|---|---|
| 5,755,213 | A * | 5/1998 | Gardner et al. | 124/73 |
| 5,957,119 | A * | 9/1999 | Perry et al. | 124/73 |
| 6,708,685 | B2 * | 3/2004 | Masse | 124/75 |
| 6,889,681 | B1 * | 5/2005 | Alexander et al. | 124/72 |
| 7,594,503 | B2 * | 9/2009 | DeHaan et al. | 124/74 |
| 7,886,731 | B2 * | 2/2011 | Masse | 124/73 |
| 8,397,705 | B2 * | 3/2013 | DeHaan et al. | 124/74 |
| 8,413,644 | B2 * | 4/2013 | Masse | 124/76 |
| 2004/0065310 | A1 * | 4/2004 | Masse | 124/75 |
| 2005/0145235 | A1 * | 7/2005 | Jong | 124/73 |
| 2006/0027223 | A1 * | 2/2006 | Vasel et al. | 124/57 |
| 2007/0012304 | A1 * | 1/2007 | van Dorsser et al. | 124/51.1 |
| 2007/0039601 | A1 * | 2/2007 | Jong | 124/73 |
| 2008/0099005 | A1 * | 5/2008 | Kaakkola et al. | 124/74 |
| 2008/0245351 | A1 * | 10/2008 | Kaakkola et al. | 124/74 |
| 2009/0056693 | A1 * | 3/2009 | Pedicini et al. | 124/73 |
| 2011/0297136 | A1 * | 12/2011 | Kaakkola et al. | 124/73 |

FOREIGN PATENT DOCUMENTS

| | | |
|---|---|---|
| TW | 092221568 | 10/2004 |
| TW | 099208496 | 11/2010 |

* cited by examiner

*Primary Examiner* — Michael David
(74) *Attorney, Agent, or Firm* — Muncy, Geissler, Olds & Lowe, P.C.

(57) ABSTRACT

The present invention provides an integrally configured flow channel system for application in the basic structure of a paintball gun, which enables increasing speed of vaporization to produce a high working pressure. The structure is solid, and maintains high safety for the operating mechanism. The system mainly includes a gun main body having a long rectangular shape and provided with heat conducting properties, and is longitudinally defined with a bolt. A chamber is defined parallel to the bolt, and a pre-vaporizer is longitudinally defined close to the chamber and the inner surface bordering on the exterior of the gun main body. One end of the pre-vaporizer affords passage to the chamber, and another end is joined to a pressure source through a lead-in port. The pre-vaporizer effectively uses the heat effectively exchanged from the heat stored by the gun main body.

5 Claims, 4 Drawing Sheets

PAINTBALL GUN FLOW CHANNEL SYSTEM

BACKGROUND OF THE INVENTION (a) Field of the Invention

The present invention provides a flow channel system for application in a paintball gun, which is integrally built in the basic structure of the paintball gun, and enables increasing speed of vaporization to produce a high working pressure. The entire structure is solid, and the operating mechanism is extremely safe, which is beneficial during actual practice and training. The configuration primarily uses a pre-vaporizer positioned close to the inner side bordering on a gun main body, which is able to rapidly absorb heat that has entered the surface of the gun main body through thermal equilibrium and pre-agitate gas molecules, thereby accelerating the speed of dissociation of the gas molecules in advance, and ultimately preparing a substantial increase in pressure in a chamber. In addition, the flow channel system is integrally and structurally protected by the physical body of the gun main body, thus achieving a system which is structurally solid and protective.

(b) Description of the Prior Art

The present invention provides a flow channel system with flow channels having a physical configuration for a paintball gun, and which is able to increase the speed of vaporization.

Paintball guns or BB guns of the prior art use a compressible gas stored in a pressure-resistant gas supply bottle, and after joining to the gun, the interior of the gas supply bottle distributes pressure into the interior of the gun body to serve as the pressure source for firing a projectile. The gas commonly used is carbon dioxide, $N_2$ (nitrogen) or HPA (high pressure air) compressed to form a liquid state, which expands into vaporized molecules after being released, producing high pressurized pressure to serve as the pressurized force for firing a projectile. The principal functional use of a paintball gun is to enable obtaining a clear and definite color marking at the point of impact, and with a force of impact that the human body can withstand. Accordingly, in order to safeguard the safety of the skin of the human body, the strength of the force of impact of the guns commonly used in international sports competitions and riot control must be regulated and controlled within the margin of safety. Hence, the pressure output of the gun is, as a matter of course, also set at a safe pressure value.

Regarding gun design of paintball guns, apart from demanding that the firing pressure be within the margin of safety, limiting the quantity of gas supplied is an issue of primary importance for designers. If the amount of pressure output is only small, but is able to achieve the required pressure after vaporization, then a corresponding saving is made on the quantity of gas supplied, thereby achieving the objective of conserving energy.

Regarding the flow channel configuration of the gun, earlier versions used a single expansion method of the gas, which then entered a bolt in preparation for firing. However, the system design resulted in dissipation of energy. More recent designs conserve energy, and the efficiency in vaporization enables achieving a higher booster effect for the loading of ink, thereby achieving the objective of conserving energy. Moreover, having a vaporizing flow channel system, the design formed a partition method of different sections, such as Taiwan patent No. 099208496, and the many kinds of related designs within the range of categories of F41 B-011 of Taiwan and international patent classifications.

In Taiwan patent No. 099208496, the interior of a gun body is partitioned into a first section, a second section and a third section. The first section and the second section form a covering structure with internal and external layers using conjugate means within the cylindrical interior of the gun, and the axis serves as the bolt design of the third section. The first section is used for a pre-gas expansion operation, and then the second section is used for storage and re-expansion, after which pressure within the second section is output to the bolt of the third section to serve as the firing pressure source. Such a design uses a coaxial conjugate internal-external layer covering structure, with the first section being used to singly and comprehensively intercept and absorb the heat conducted inward from the outer surface of the gun body. Hence, the second section is unable to obtain heat from the gun body, causing the speed of expansion to be not so evident.

In addition, Taiwan patent No. 92221568 similarly provides a vaporization mechanism for a paintball gun. The patent discloses that a diverging tube is fitted underneath the front side of a gun body, and the diverging tube is joined to a gas supply bottle through a high-pressure guide tube. The diverging tube serves as a handle mode of operation for firing, whereby the temperature of the palm of the user is directly conducted into the gun, causing a pressure booster component to effect a pressure boosting operation resulting from the heat. The pressure then directly enters a gas storage tube, thereby providing a pre-boost vaporization operation effect. The objective being to conserve usage amount of the pressure source. However, the design uses a guide tube joined to the pressure source, which affects the all-terrain operational design of the gun. Moreover, the guide tube is an exposed component, and is a linear tubular device, which is disadvantageous should objects collide with the guide tube during training and sports games or when holding and operating the gun. In particular, when in a posture lying prostrate with the gun set up on the ground aiming at a target, the guide tube may collide with objects underneath the gun, such as a low wall or the tops of stones, causing the guide tube to rupture due to the collision and endangering personal safety.

Nowadays, such designs of the outward appearance of current guns are disadvantageous to adopt under the prerequisite for realism when training and in sport simulation contests.

SUMMARY OF THE INVENTION

The primarily objective of the present invention lies in providing an integrally configured and concealed built-in flow channel system within the same physical body in the basic structure of a gun main body, enabling an increase in the speed of vaporization to produce a high working pressure. In addition, providing a structure that is solid, and maintains a highly safe flow channel system, primarily using a gun main body having a long-rectangular physical body and heat absorption properties, with the interior longitudinally parallel defined with an independent tubular bolt and a chamber, and a pre-vaporizer defined close to a side of the chamber. The pre-vaporizer is used to pre-absorb heat reserved in advance in the gun main body to intensify the energization of gas molecules and facilitate producing a high working pressure when accumulating pressure for the second time.

The second objective of the present invention lies in joining at least one or more than one of the pre-vaporizers defined in the interior of the gun main body to a lead-in port through a distributor path.

The third objective of the present invention lies in the rear end of the gun main body being fitted with a port, which is used to directly function as a rear end capping. Moreover a locking interface provided on the port is used to axially lock to a gas supply bottle, thereby enabling the gas within the gas supply bottle to directly enter the lead-in port and be channeled to the pre-vaporizer. The port is structural mechanically joined to the main body, thereby strengthening the structural integrity and degree of safety.

The fourth objective of the present invention lies in the bolt, the chamber and the pre-vaporizer fitted in the interior of the gun main body, which are formed using a deep processing method.

The fifth objective of the present invention lies in the exterior of the gun main body, which is provided with heat absorbing curved surfaces that expanded the areas in contact with the surroundings or heat absorbing fins through irregular shaping of the exterior, thereby enabling the gun main body to rapidly obtain heat, accelerate pressurizing the gas and increase the speed of expansion.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
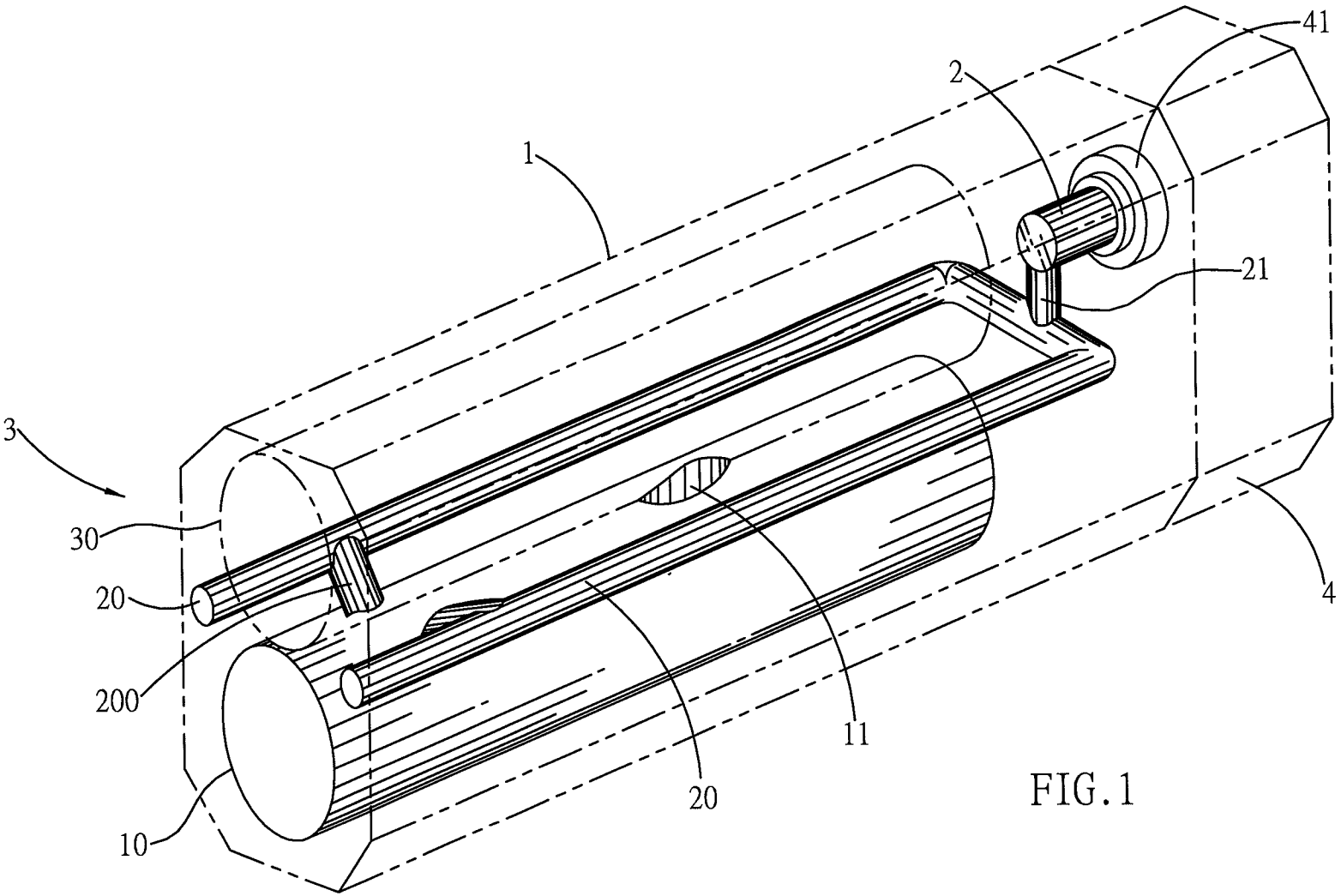
FIG. 1 is a three-dimensional structural schematic view depicting a tube valve flow channel system of the present invention.

The present invention provides a new flow channel system for a paintball gun, comprising the integral disposition of a bolt, a chamber and a pre-vaporizer within the basic structure of a physical body. The bolt, the chamber and the pre-vaporizer are independent tubular bodies, which are longitudinally parallel disposed in the interior of the gun main body. The pre-vaporizer is used for pre-absorption of the heat conducted from the surface of the gun main body, and serves to effect a pre-vaporization operation, whereby vaporization creates a pressure build up, and the pressure enters the chamber to form a reference value for the pressure expansion booster of the interior space of the chamber, enabling an increase in pressure within the chamber at the initial expansion. The chamber provides an expansion space, and after receiving the gas source that has already reached an increased pressure value effected in the pre-vaporizer, a second expansion is carried out to accumulate a higher pressure, thereby enabling the chamber to obtain a high-pressure pressure load.

In principle, the mass ratio of the gas element pressure source present in the interior of the gas supply bottle and air is taken into consideration to determine the size of the pressure produced. Generally speaking, the larger the pressure proportion is, the larger the amount of vaporization, and the higher the pressure.

Regarding the operating principle of the gas expansion, apart from a spatial volume of specified value, the pressure and temperature are in a direct proportional relationship. Hence, changes in temperature directly affect the pressure value. In order to achieve a higher working pressure in a volume space of specified value, raising the temperature correspondingly increases the pressure. The working temperature primarily agitates the internal gas molecules, causing the gas molecules to oscillate at high speed. Moreover, agitation caused by temperature energizes the internal gas molecules, resulting in the gas molecules dissociating and continuously colliding with the interior walls of the spatial volume, thereby creating a pressure. The higher the temperature is, the higher the speed of dissociation is, and the pressure correspondingly increases.

The present invention provides an integral structure and uses the gun main body provided with heat conduction and heat storage capabilities. The interior is longitudinally defined with a pre-vaporizer adjacent to the inner side bordering the surface of the gun main body. One end of the pre-vaporizer affords passage to the internally configured chamber, and the other end affords passage to the pressure source through a port. After gas introduced into the gas supply bottle is guided towards the pre-vaporizer through the port, then the internal space of the pre-vaporizer effects an expansion operation. The expansion operation uses heat from the internal surface of the pre-vaporizer which directly relates to the physical body of the gun main body. The exterior of the gun main body absorbs heat from the surroundings through contact or transfer by radiation. After the heat enters the gun main body, the molecules in the interior of the gun main body are first energized, and once the internal molecules have become agitated, then a thermal equilibrium effect is produced, causing heat transfer to the internal surface of the pre-vaporizer, whereupon the heat is exchanged with the gas internally filled therein. Heating of the gas molecules causes agitation and dissociation thereof, resulting in a vaporization operation that lead to pressure expansion, which is channeled to accumulate in the chamber through branch tubes. The main body of the chamber is configured in the physical body of the gun main body, and the internal space of the chamber is able to energize the gas molecules filled therein by means similar to that of the pre-vaporizer. The pre-vaporizer serves to effect pre-vaporization, and after the branch tubes channel the gas into the interior of the chamber, then, initially, a specified value of pressure is created in the chamber. Accordingly, the pressure first entering the chamber is the initial value of the pressure boost, thus, the initial pressure value of the chamber is decided by the pre-vaporizer, and the chamber effects a second pressure boost operation. The chamber thus builds up the pressure boost by adding to the reference pressure value introduced from the pre-vaporizer. Moreover, there is a physical relation between the internal surface of the position of the chamber and the exterior of the gun main body, and thus a huge probability for the chamber to directly absorb the heat that has entered the outer surface of the gun main body. Accordingly, the interior of the chamber can serve to effect a second pressure boost operation. When operating the gun, the amount of pressure stored in the chamber fills the bolt configured in the firing portion to serve as the basis for the pressure to fire a projectile.

In the present invention, the bolt, the chamber and the pre-vaporizer provided in the interior of the gun main body are independent, parallel tubular configurations, which can be formed using a deep drilling processing method. The port is joined to the rear section of the gun main body, and the port is provided with a locking interface, which affords passage to the gas supply bottle. The locking interface is coaxially aligned with the lead-in port provided on the gun main body, and the pressure in the gas supply bottle is guided into the gun main body through the lead-in port and distributed into the pre-vaporizer. The port is joined to the rear section of the gun main body, which apart from providing convenient processing, the port also functions as an end capping. Moreover, using a method whereby the rear surface of the port is longitudinally lock joined to the gas supply bottle, the port provides the gun main body with a convenient design to strengthen structural integrity and increase safety of the gun.

Regarding the detailed content and structural methodology of the present invention, please refer to the description of the diagrams as follows:

Referring first to FIG. 1, which shows a gun main body 1 of the present invention, which is made from metal material provided with heat conduction and heat storage properties, and has a long-rectangular shape. The upper portion of the interior is longitudinally provided with a firing portion 3. The main space of the firing portion 3 provides an independent bolt 30, and a chamber 10 is provided beneath and parallel to the bolt 30. An independent pre-vaporizer 20 is provided adjacent and parallel to the chamber 10 close to the position bordering on the inner side of the gun main body 1. The pre-vaporizer 20 affords passage to the chamber 10 through branch tubes 200. The interior of the chamber 10 affords passage to the bolt 30 through a guide hole 11, and the bolt 30 is part of the firing portion 3.

Another end of the pre-vaporizer 20 affords passage to a lead-in port 2 through a distributor path 21. The rear end of the lead-in port 2 affords passage to the pressure source through a locking interface 41, and the locking interface 41 is located at the position of a port 4. The port 4 serves as an end capping element for follow up assembly to the gun main body 1. The locking interface 41 of the port 4 affords passage to and is joined to the lead-in port 2. The bolt 30, the chamber 10 and the pre-vaporizer 20 are formed using a deep drilling processing method. The port 4 serves as an end capping for the bolt 30, the chamber 10 and the pre-vaporizer 20. The pre-vaporizer 20 is positioned at the inner side of the exterior of the gun main body 1 close to the chamber 10, and the pre-vaporizer 20 absorbs the heat taken in by the exterior of the gun main body 1, thereby providing the basis for the pressure expansion work of gas molecules. There is also a large probability that the chamber 10 can similarly absorb the heat taken in by the exterior of the the gun main body 1.

Figure 2:
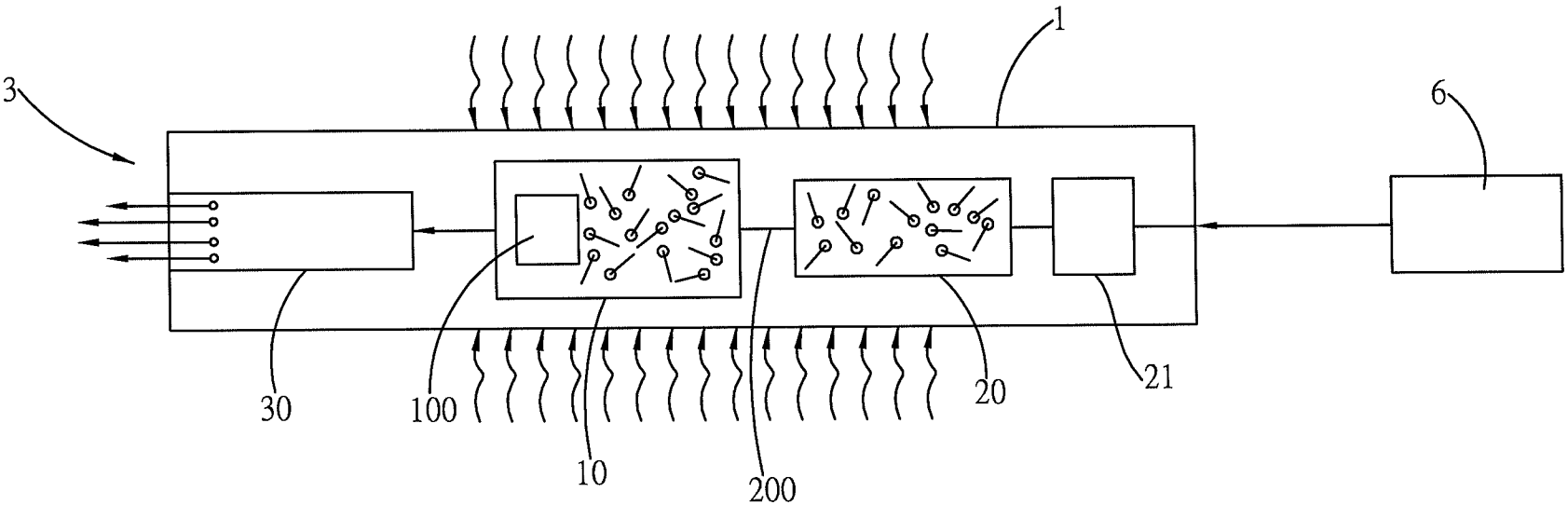
FIG. 2 is a schematic view depicting the flow channel system arranged in the physical interior of a gun main body and the flow paths of the present invention.

Referring to FIG. 2, based on the operating mode of the present invention, the gun main body 1 is linked to a gas supply bottle 6 through the distributor path 21. The gas supplied by the gas supply bottle 6 first enters the pre-vaporizer 20, and the pre-vaporizer 20 is used to absorb the heat obtained by the surface of the gun main body 1. The spatial inner surface of the pre-vaporizer 20 exchanges the heat with the gas filling the interior thereof, whereupon the heat agitates the internal gas molecules and increases the speed of dissociation thereof, causing the gas molecules to collide with the inner surface of the spatial volume of the pre-vaporizer 20, thus creating a pressure. The pressure created serves to form a pre-expansion operation, and after obtaining a specified pressure value, the pressure is channeled to the chamber 10 through the branch tubes 200. The spatial inner surface of the chamber 10 similarly relates with the internal physical body of the gun main body 1, and similar to the operating mode of the internal surface of the pre-vaporizer 20, the chamber 10 is able to directly obtain the heat transferred in from the internal physical body of the gun main body 1.

After the heat enters the internal surface of the chamber 10, the heat is exchanged with the gas molecules delivered under pressure by the pre-vaporizer 20. Hence, the interior of the chamber 10 obtains a rise in temperature for the second time, and the pre-dissociated gas molecules within the interior of the chamber 10 are provided with a rapid boost in energy, causing acceleration in the speed of dissociation of the internal gas molecules and a substantial rise in the internal gas pressure within the chamber 10.

Expansion ratio of the gas molecules determines the target pressure value, the prerequisite factor being determined by the stored internal pressure source, such as the mass ratio of carbon dioxide and air. Through actual tests of the present invention, the pressure load within the chamber 10 can be substantially increased to a high pressure value through subsidiary operation of the pre-vaporizer 20.

In the firing operation of the present invention, the pressure stored in the chamber 10 is determined directly through an operating valve 100, with the pressure being transferred towards the bolt 30 provided in the firing portion 3 and used to serve as the operating basis for firing a projectile. Because the chamber 10 and the internal surface of the pre-vaporizer 20 directly relate to the physical main body gun main body 1, thus, based on similar operating methods, both the pre-vaporizer 20 and the chamber 10 can absorb the heat transmitted into the exterior of the gun main body 1. The heat can be conducted via heat radiation waves or by hand contact, or through exchange with the gas temperature, and enter the chamber 10 or the inner surface of the pre-vaporizer 20 through thermal equilibrium. The structural design of the present invention enables both the chamber 10 and the pre-vaporizer 20 to obtain the heat entering the surface of the gun main body 1 to a similar degree. Because the pre-vaporizer 20 is configured in the interior of the main body of the gun main body 1 as an integral body thereof, thus, the periphery of the pre-vaporizer 20 and the chamber 10 both receive protection of the enclosing physical body of the gun main body 1. Moreover, the bolt 30 can be independent or configured in the interior of the main body of the gun main body 1 as an integral body thereof, to achieve the objective of forming a solid and safe structure, and facilitate use in training and sports contests, as well as preventing external forces from easily damaging the structural safety of the chamber 10 or the pre-vaporizer 20. The bolt 30 is externally connected to the gun barrel (not shown in the drawings).

Figure 3:
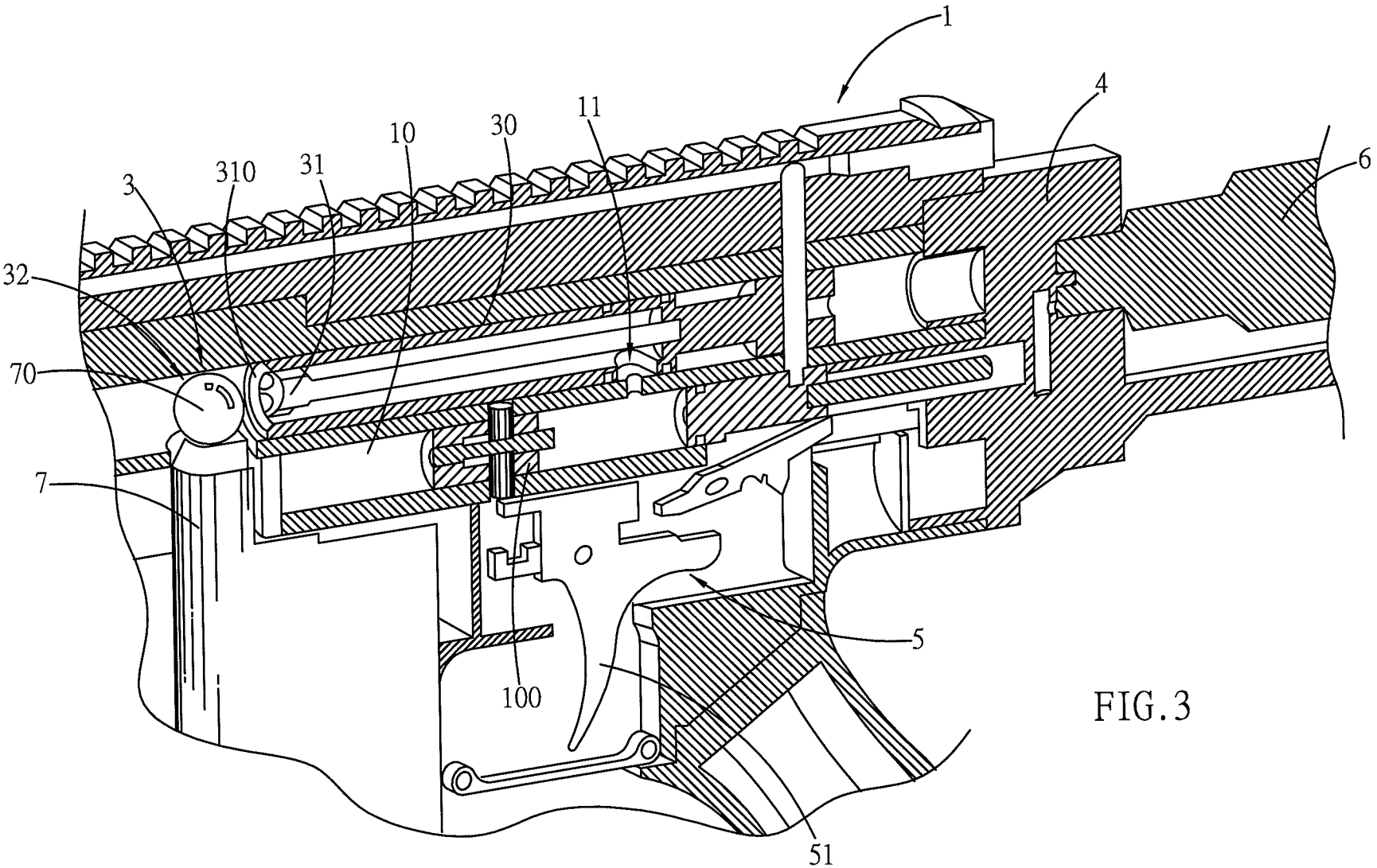
FIG. 3 is a cutaway view depicting an embodiment of the structural arrangement of the assembled gun of the present invention.

Referring to FIG. 3, based on an embodiment of the present invention, the gun main body 1 is made from a physical body of metallic material provided with heat conduction and heat storage effectiveness. The upper portion of the interior is fitted with the bolt 30, and the interior of the bolt 30 is pivotally disposed with a rectifier tube 31. The front end of the rectifier tube 31 is provided with an interface 310, and the bolt 30 forms the firing portion 3 after joining to the rectifier tube 31.

The gun assembly is equipped with a bullet delivery device 7 at the working position of the interface 310 provided at the front end of the rectifier tube 31. The bullet delivery device 7 uses a squeezing method to push a projectile 70 to a chamber opening 32 defined in the firing portion 3. After being positioned, the projectile 70 is received by the interface 310 of the rectifier tube 31, whereupon the projectile 70 is subjected to the pressure source and fired. The rectifier tube 31 is provided with rectification effectiveness, which causes the pressurized gas to form a columnar spray that is expelled toward the surface of the projectile 70, and the pressure causes the projectile 70 to fire out the gun barrel. The basic structural design of the present invention comprises the chamber 10 configured underneath the bolt 30 (see FIG. 1). The interior of the chamber 10 is equipped with the working valve 100, and one end of the chamber 10 is joined to the pre-vaporizer 20 through the branch tubes 200. The pre-vaporizer 20 affords passage to the gas supply bottle 6 lock joined to the port 4 through the distributor path 21 and the lead-in port 2, enabling the internal gas of the gas supply bottle 6 to fill the chamber 10. Through the aforementioned expansion operation, operation of the working valve 100 selects the time when the high pressure load of the chamber 10 is delivered to the bolt 30, thereby enabling the rectifier tube 31 to serve as the operating condition for firing the projectile 70.

The operating valve 100 is operated by a trigger 51 fitted to a trigger assembly 5. The operator pulls the trigger 51 to determine operation of the operating valve 100, after which an operating time is effected for the pressurized gas in the interior of the chamber 10, and the pressure flows toward the interior of the bolt 30, whereupon the projectile 70 is fired through operation of the rectifier tube 31.

Prior to the trigger 51 being pulled, the operating valve 100 locks the spatial volume of the chamber 10, enabling the chamber 10 to form a sealed pressure storing space. After the trigger 51 is pulled, the pressure in the interior of the chamber 10 flows toward the bolt 30 through the guide hole 11, whereupon the pressure in the internal space of the chamber 10 falls. However, after pulling the trigger 51, the operating valve 100 rapidly seals the spatial volume of the chamber 10 again, and pressure from pre-vaporization of the pre-vaporizer 20 is diverted into the chamber 10 through the branch tubes 200, whereupon the pressure undergoes expansion in the interior of the chamber 10 for the second time. Hence, similarly, a large pressure value accumulates in the chamber 10 to prepare for a second firing of a projectile, thus forming a continuous firing operation. The continuous supply of the projectiles 70 is achieved through the design of the bullet delivery device 7.

Figure 4:
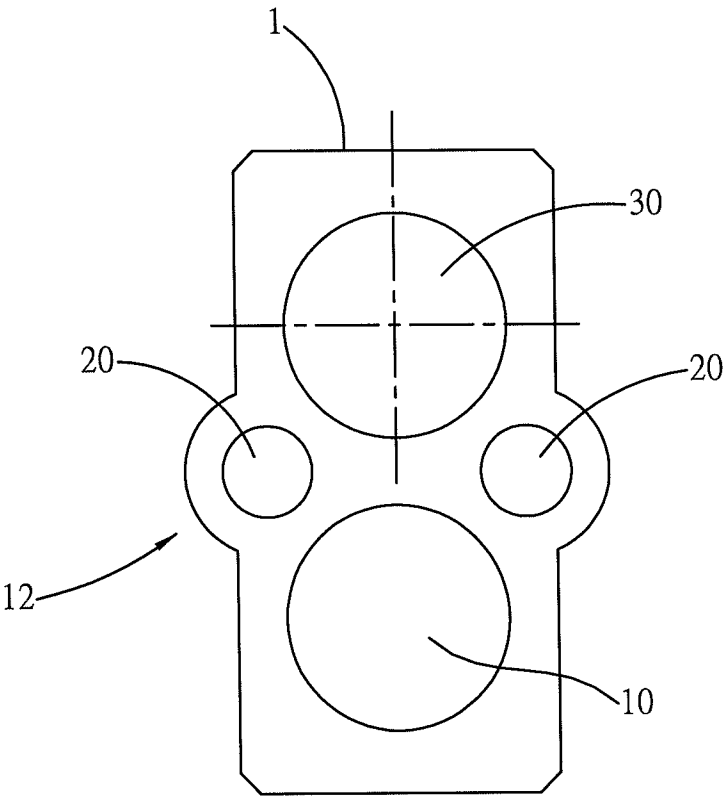
FIG. 4 is a schematic view depicting an interface of the gun main body of the present invention.

Referring to FIG. 4, in order for the chamber 10 to be able to rapidly obtain and accumulate a high pressure load, the preceding pre-vaporizer 20 must rapidly transfer the heat taken in from the gun exterior, thus, the peripheral external surface of the gun main body 1 corresponding to the pre-vaporizer 20 is defined with heat absorbing curved surfaces 12, which enlarge the area in contact with the temperature thereat. The surface areas of the heat absorbing curved surfaces 12 are enlarged, and the quantity of heat absorbed per unit time is increased, thereby providing the fixed internal space of the pre-vaporizer 20 with a heat source for a heat exchange operation. Moreover, the design of the heat absorbing curved surfaces 12 enables enlarging the internal space of the pre-vaporizer 20, and with the internal space of the pre-vaporizer 20 enlarged, then the internal surface thereof is correspondingly increased, thereby enabling the gas molecules prior to expansion to obtain a larger quantity of heat. Hence, the pre-pressure boost operation enables achieving a higher pre-pressure value, which facilitates the chamber 10 effecting a second expansion operation to obtain an even higher reference pressure and further build up the pressure expansion operation using the accumulated higher pressure in the interior of the chamber 10. The size of the space must also take into account the specific weight relationship between the pressure source gas element and the air. With a specific weight relationship of specified value, and with the size of the space within the range of a narrow and small gun, then the pre-vaporizer 20 can be defined with an enlarged space.

Figure 5:
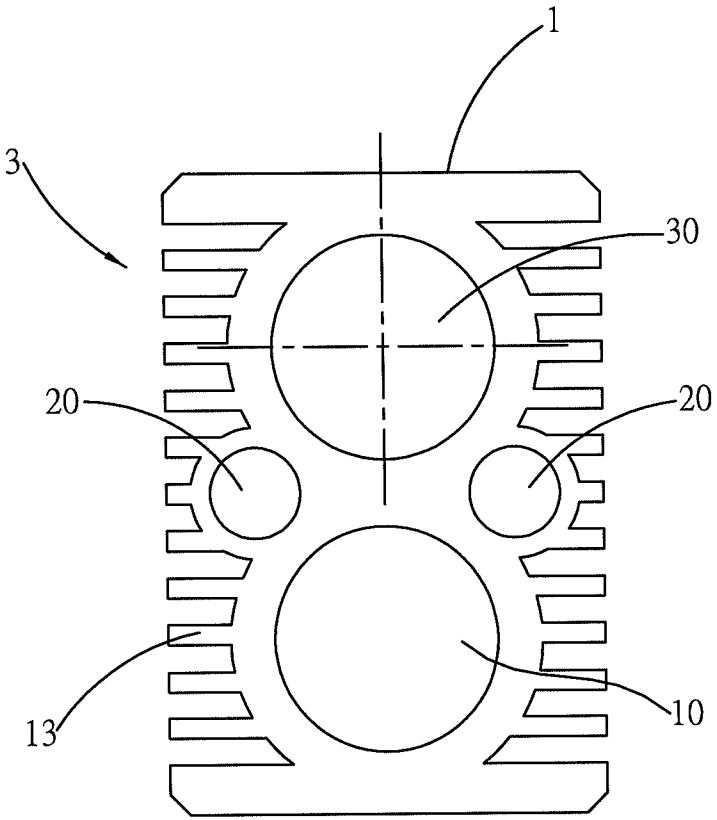
FIG. 5 is schematic view depicting another interface of the gun main body of the present invention.

Referring to FIG. 5, in order that the pre-vaporizer 20 or the chamber 10 or even the bolt 30 is able to rapidly transfer heat from the surroundings, the exterior of the gun main body 1 can be configured with heat absorbing fins 13. The heat absorbing fins 13 are able to substantially enlarge the external area of the gun main body 1, thereby enabling the gun main body 1 to rapidly and equally absorb and transfer high heat from the surroundings to the inner surface of the bolt 30 or the pre-vaporizer 20 or the chamber 10. Accordingly, during operation, the gun obtains a relatively high and sufficient quantity of heat, which correspondingly increases the pressure expansion, and increases the working pressure of the bolt 30.

The present invention provides a design concept comprising a tube valve flow channel system configured as an integral body, and uses the internal pre-vaporizer 20 to effect a preceding pre-expansion operation that enables working gas molecules to obtain a pressure, after which the pressure enters the interior of the chamber 10 to form a reference pressure value. The expansion operation in the chamber 10 accumulates further pressure expansion adding to the reference pressure value, thereby enabling the chamber 10 to obtain a high-pressure pressure load that facilitates operation therein. The pre-vaporizer 20 and the chamber 10, even the bolt 30, are independent tube bodies, which are respectively longitudinally disposed in the interior of physical body of the gun main body 1, and receive the structural safety and protection of the physical body of the gun main body 1. Moreover, the inner surfaces of the pre-vaporizer 20 and the chamber 10, even the bolt 30 physically relate to the gun main body 1. Hence, the high temperature heat received by the exterior of the gun main body 1 can be directly transmitted to the inner surface of the pre-vaporizer 20 or the chamber 10. In addition, the position defined by the pre-vaporizer 20 close to the chamber 10 is located at the border position of the inner side of the physical body of the gun main body 1. Hence, because the pre-vaporizer 20 is configured close to the exterior of the gun main body 1, the pre-vaporizer 20 is able to directly absorb the heat that has been transmitted into the exterior of the gun main body 1 through a relatively short path. Based on the design of the present invention, the physical structure is exceedingly safe, and is a design that facilitates gun simulation use, as well as further achieving an increase in the working pressure, which enables the chamber 10 to obtain a high-pressure working pressure, thereby correspondingly economizing on the usage amount of the pressure source. Furthermore, the bolt 30 or the pre-vaporizer 20 or the chamber 10 configured in the interior of the gun main body 1 are formed using a deep drilling processing method. The port 4 enables direct joining to the rear end of the gun main body 1, and serves as an end capping for the rear section of the gun main body 1, with the gas supply bottle 6 lock joined to the port 4. Accordingly, the present invention is assuredly provided with an innovative structural design.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A paintball gun flow channel system, comprising:

a solid gun main body, wherein the gun main body is longitudinal in shape and is provided with heat conducting properties, an upper portion of an interior of the gun main body is longitudinally configured with an independent bolt, and a lower portion of the gun main body is longitudinally configured with an independent chamber parallel to the bolt; one end of the chamber affords passage to the bolt through a guide hole, and another end of the chamber affords passage through branch tubes to a pre-vaporizer similarly longitudinally configured within and positioned close to an inner surface bordering on an exterior body of the gun main body; ahead end of the pre-vaporizer is connected to a lead-in port;

an operating valve, wherein the operating valve is freely located in an interior of the chamber, and determines whether or not the pressure in the chamber is routed to the bolt;

a port, wherein the port is seal joined to the rear end side of the gun main body and provided with a locking interface, the locking interface is axially joined to the lead-in port.

2. The paintball gun flow channel system according to claim 1, wherein the lead-in port is branch connected to one or more than one of the pre-vaporizers through a distributor path.

3. The paintball gun flow channel system according to claim 1, wherein the pre-vaporizer is parallel and close to the chamber.

4. The paintball gun flow channel system according to claim 1, wherein the exterior of the gun main body covers the spatial form of the pre-vaporizer, and is configured with protruding heat absorbing curved surfaces.

5. The paintball gun flow channel system according to claim 1, wherein the exterior of the gun main body is configured with heat absorbing fins corresponding to the surfaces of the pre-vaporizer.

* * * * *